US005613563A

United States Patent [19]

Johnson

[11] Patent Number: 5,613,563

[45] Date of Patent: Mar. 25, 1997

[54] LOCKING MECHANISM FOR QUICK RESPONSE FIRE SPRINKLER

[76] Inventor: Kimball W. Johnson, P.O. Box 126, Orleans, Vt. 05860

[21] Appl. No.: 518,399

[22] Filed: Aug. 15, 1995

[51] Int. Cl.[6] ..... A62C 37/11

[52] U.S. Cl. ..... 169/39; 169/42

[58] Field of Search ..... 169/37, 38, 39, 169/40, 41, 42, 90

[56] References Cited

U.S. PATENT DOCUMENTS

| | | | |
|---|---|---|---|
| 4,465,141 | 8/1984 | Johnson | 169/37 |
| 4,508,175 | 4/1985 | Pieczykolan | 169/38 |
| 4,618,002 | 10/1986 | Mears | 169/37 |
| 4,664,198 | 5/1987 | Johnson | 169/38 |
| 4,766,961 | 8/1988 | Macie | 169/38 |
| 4,977,963 | 12/1990 | Simons | 169/37 |

*Primary Examiner*—Andrew C. Pike
*Attorney, Agent, or Firm*—Brady, O'Boyle & Gates

[57] ABSTRACT

A locking mechanism for a quick response fire sprinkler includes an arcuate leaf spring having an inherent radially inwardly directed biasing force being split to provide spaced end portions. A circumferentially extending detent is provided in the peripheral face of the arcuate leaf spring for engaging a circumferential groove provided in the sprinkler valve housing. A fusible temperature responsive element is inserted between the spaced ends of the arcuate spring for spreading the arcuate spring and associated detent radially outwardly into the circumferential groove for holding the sprinkler valve in the closed position. When the temperature responsive element becomes fused, the arcuate leaf spring is retracted radially inwardly from the valve housing allowing the sprinkler valve to open.

14 Claims, 7 Drawing Sheets

LOCKING MECHANISM FOR QUICK RESPONSE FIRE SPRINKLER

BACKGROUND OF THE INVENTION

Various fire sprinkler systems have been proposed having a slidable valve held in a closed position by a locking mechanism releasably held by an ambient temperature responsive element, whereby when the ambient temperature reaches a certain elevation, the temperature responsive element is actuated releasing the locking mechanism, thereby allowing the valve to slide to the open position.

The locking mechanism most frequently employed in these sprinkler systems includes a ball-lock arrangement wherein a plurality of circumferentially spaced balls extend between the valve and the temperature responsive element, whereby the force biasing the valve to the open position is distributed evenly to all of the balls, thereby preventing too much stress being transmitted to any single part of the lock. While these locking mechanisms have been satisfactory for their intended purpose, they are expensive, they involve many small, close tolerance machine parts, and they are difficult to assemble.

After considerable research and experimentation, the locking mechanism of the present invention has been devised which is comparably inexpensive, has few parts, and is easy to assemble.

SUMMARY OF THE INVENTION

The locking mechanism of the present invention comprises, essentially, an arcuate, leaf spring having a split, providing spaced end portions, and a radially inwardly directed biasing force. A circumferentially extending detent is provided in the peripheral face of the arcuate leaf spring adapted to engage a circumferential groove provided in the valve housing. A temperature responsive element is inserted between the spaced ends of the arcuate spring to thereby spread the arcuate spring and associated detent radially outwardly into the circumferential groove, whereby the arcuate spring holds the sprinkler valve in the closed position.

The circumferentially extending detent can be of various forms such as a plurality of circumferentially spaced semispherical protrusion provided in the peripheral face of the arcuate leaf spring, or an annular ring mounted in an annular groove provided in the peripheral face of the arcuate leaf spring.

DESCRIPTION OF THE PREFERRED EMBODIMENTS

Figure 1:
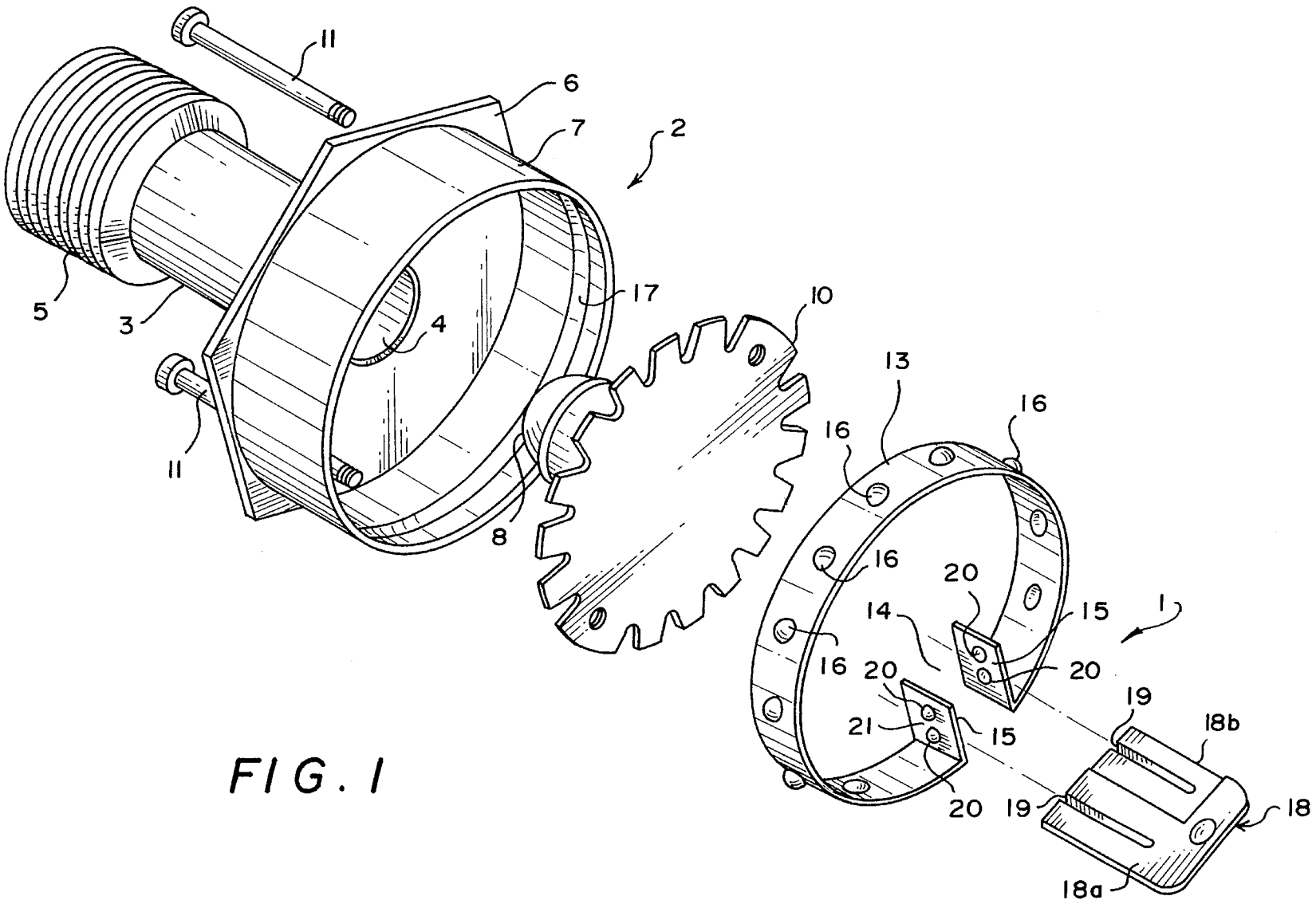
FIG. 1 is an exploded view of the locking mechanism of the present invention and associated sprinkler valve components.
Figure 2:
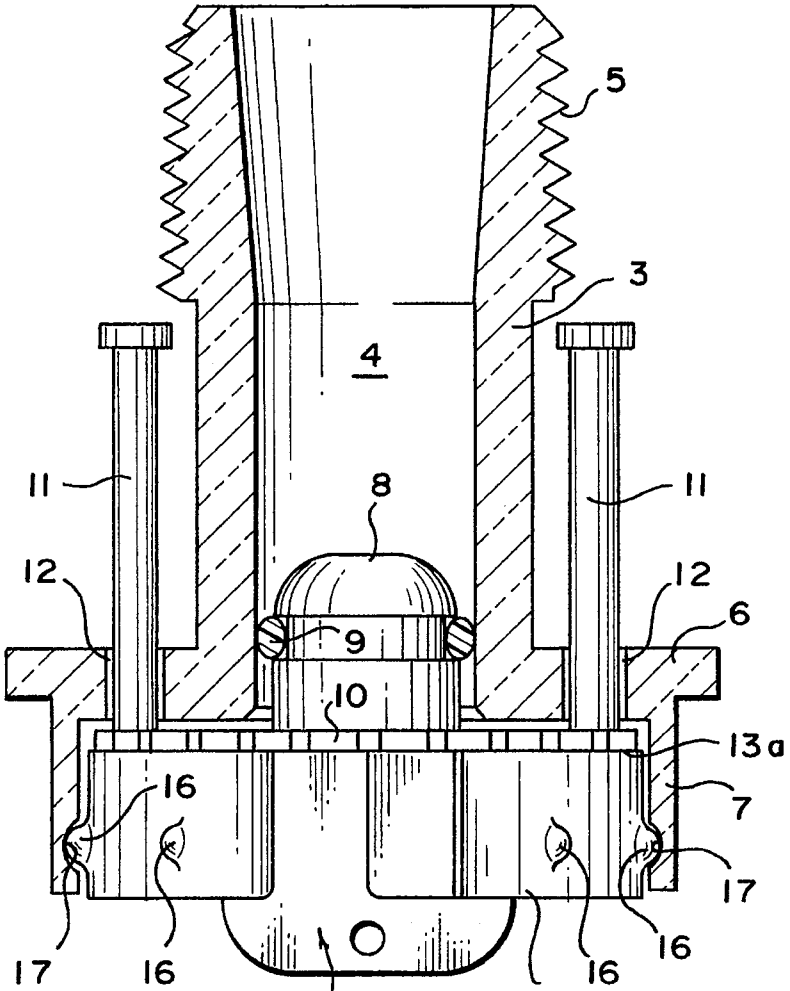
FIG. 2 is a side elevational view, partly in section, showing the locking mechanism of the present invention holding the sprinkler valve in the closed position.

Referring to the drawings and, more particularly, to FIGS. 1 and 2, the locking mechanism 1 of the present invention is adapted to be mounted in a conventional fire sprinkler 2 including a valve housing 3 having a through bore 4 and a threaded end portion 5 at one end thereof adapted to be connected to a source of pressurized water. The opposite end portion of the valve housing 3 is provided with an outwardly extending flange 6 and a depending cylindrical skirt portion 7. A plug valve 8, having an 0-ring 9, is slidably mounted in the bore 4, and a deflector plate 10 is integral with the plug valve 8. The sliding movement of the plug valve 8 and associated deflector plate 10 is guided by pins 11 connected to the deflector plate 10 and extending through apertures 12 provided in the valve housing flange 6.

The locking mechanism 1 of the present invention is employed for holding the valve 8 in the closed position, as shown in FIG. 2, and comprises an arcuate leaf spring 13, split as at 14, and provided with inwardly extending tabs 15. A plurality of circumferentially spaced semispherical protrusions 16 are provided on the outer peripheral face of the leaf spring and are adapted to engage a circumferential groove 17 provided on the inner surface of the valve housing skirt portion 7. The arcuate spring 13 has an inherent inwardly directed biasing force; therefore, to expand the spring 13 to force the protrusions 16 into the groove 17, a fusible link 18 is employed having a pair of laminated plates **18*a* and 18*b* held together by a low melting point solder and having parallel, spaced slots 19 into which the tabs 15 are inserted whereby the spring 13 is forced radially outwardly. Each tab 15 is provided with a pair of spaced hemispherical protrusions 20, the slots 19 in the fusible link being received in the space 21 between the protrusions. When, in the operative position, the upper peripheral edge 13*a* of spring 13 abuts the bottom face of the deflector plate 10 for holding the valve 8** in the closed position.

Figure 3:
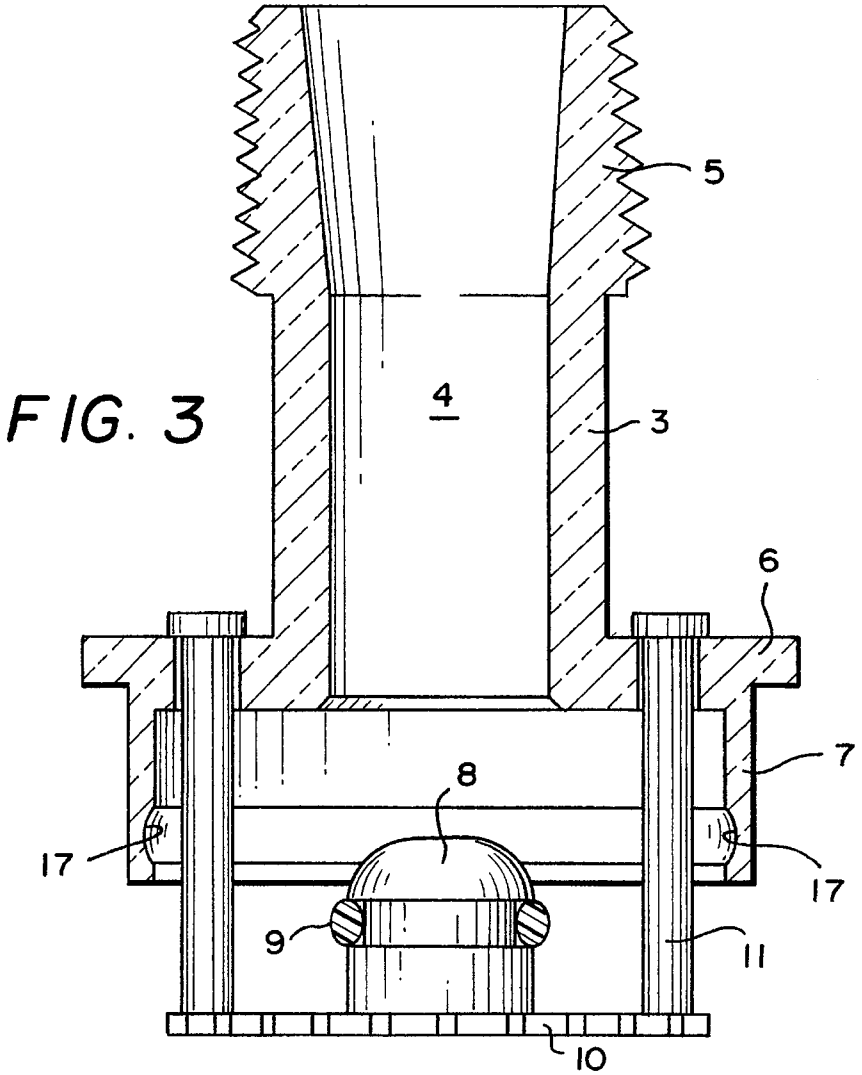
FIG. 3 is a side elevational view, partly in section, showing the sprinkler valve in the open position.

During a fire, when the ambient temperature reaches a predetermined elevation, the fusible link 18 melts and breaks apart allowing the arcuate spring 13 to retract inwardly from the groove 17, whereby the entire locking mechanism 1 is ejected from the skirt portion 7 of the valve housing, thereby allowing the plug valve 8 and associated deflector plate 10 to slide downwardly out of the valve housing 3, as shown in FIG. 3, to emit water onto the fire.

Figure 4:
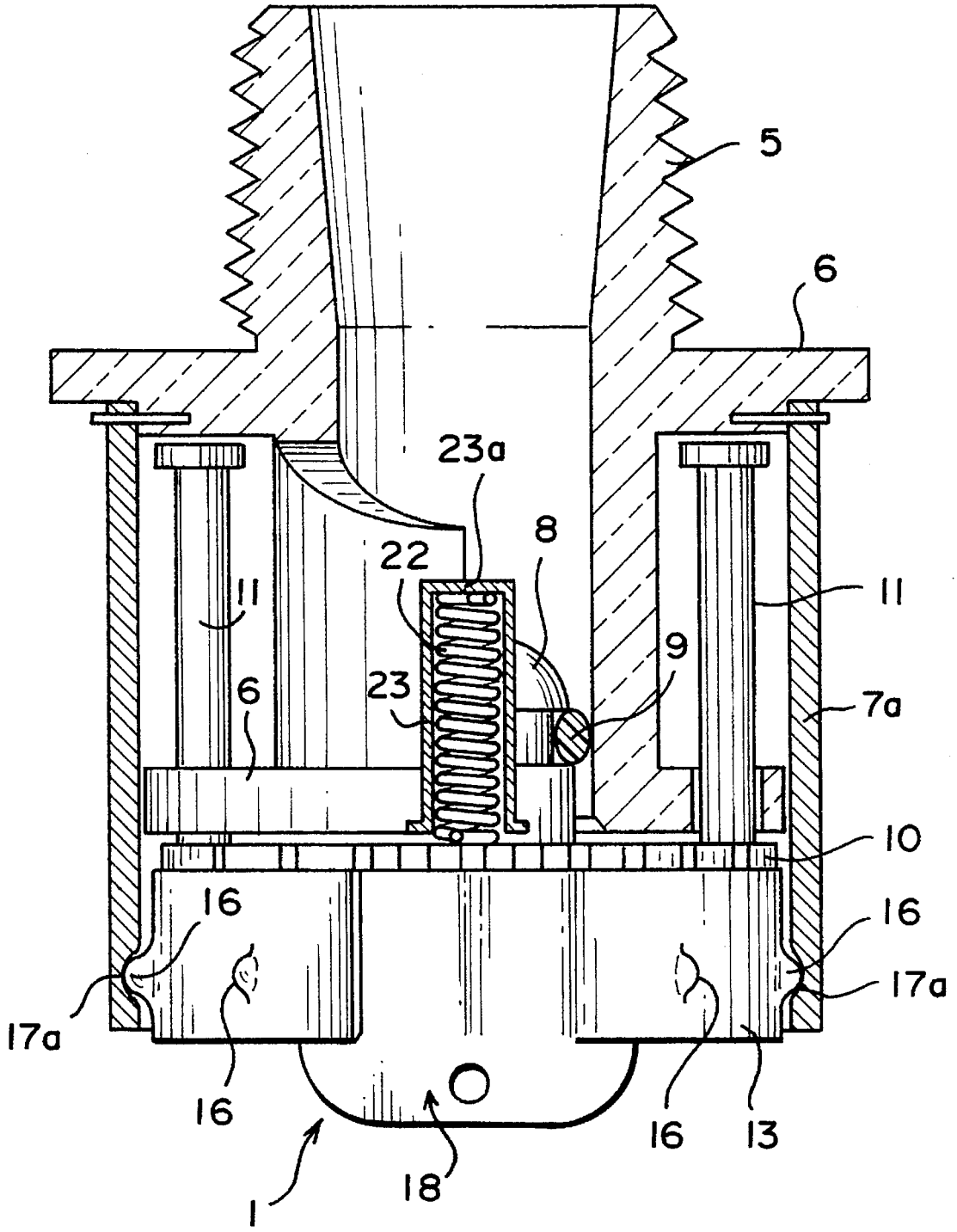
FIG. 4 is a side elevational view, partly in section, illustrating the locking mechanism of the present invention mounted in a sprinkler valve assembly having springs biasing the valve to an open position, and a depending sleeve connected to the valve housing.

FIG. 4 illustrates the installation of the locking mechanism 1 of the present invention on a sprinkler wherein the valve housing has an extended depending skirt portion **7*a* having a circumferential groove 17*a* on the lower end thereof, and a compression spring 22 mounted in a housing 23 secured to the valve housing flange 6, the spring 22 being biased between the end wall 23*a* of the housing 23 and the deflector plate 10. While only one spring assembly is shown, it should be understood that another spring assembly is provided on the other side of the valve housing, diametrically opposite the first spring assembly. By this construction and arrangement, when the fusible link 18 breaks, the opening of the plug valve 8 is assisted by the extension of the springs 22**.

Figure 5:
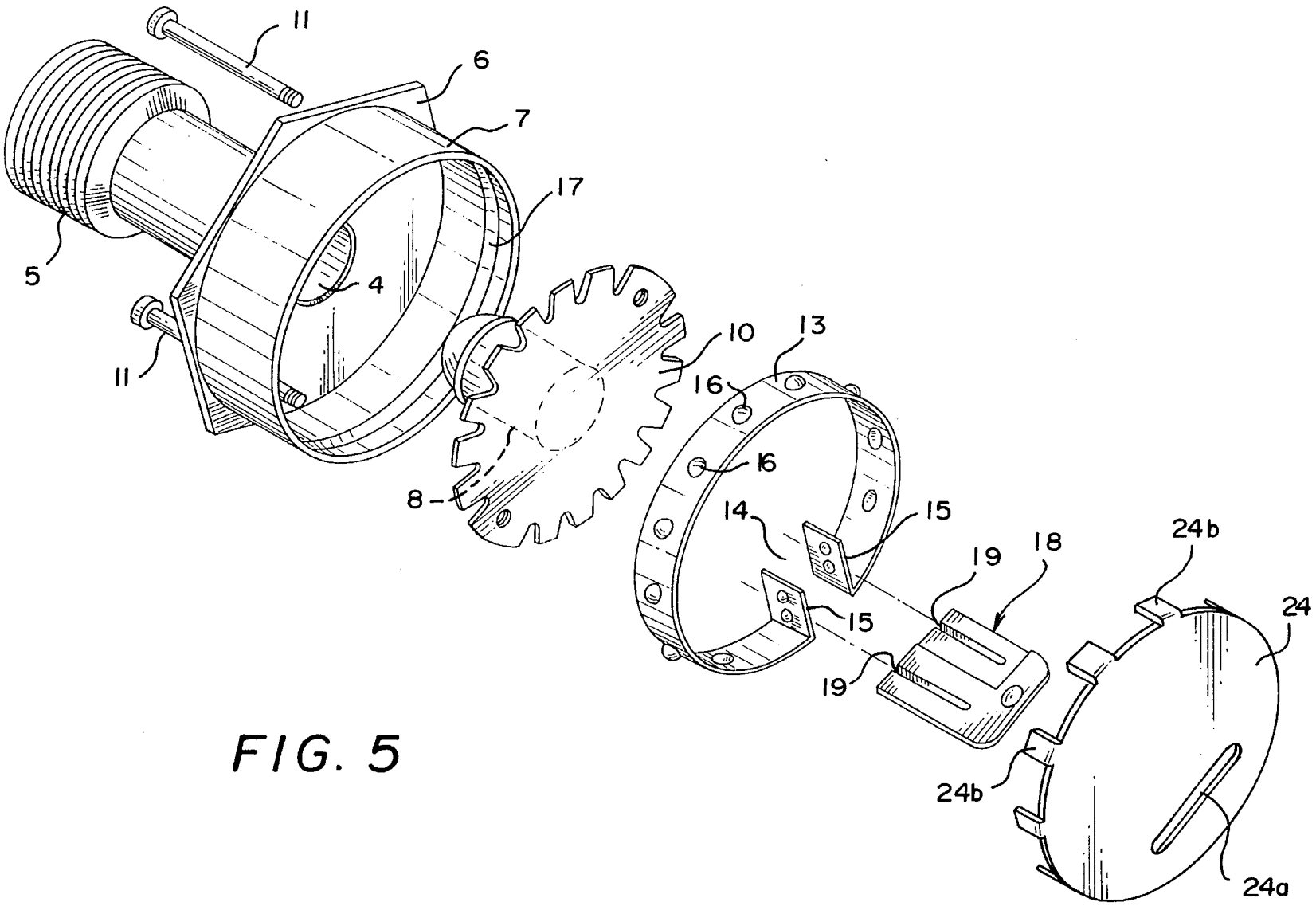
FIG. 5 is an exploded view of the locking mechanism and sprinkler valve components similar to FIG. 1 but also including a decorative cover plate.

FIG. 5 illustrates the sprinkler system of FIG. 1 with the addition of a decorative cover 24 having a slot 24*a* through which the fusible link 18 is adapted to extend. A plurality of circumferentially spaced tabs 24*b* are also provided which frictionally engage the annular spring 13 in the space between adjacent protrusions 16.

Figure 6:
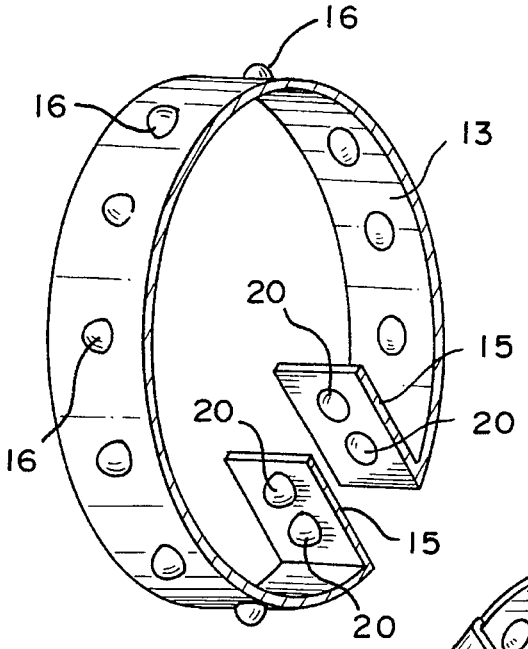
FIGS. 6, 7, and 8 are perspective views of various embodiments of the arcuate leaf spring employed in the locking mechanism of the present invention.
Figure 7:
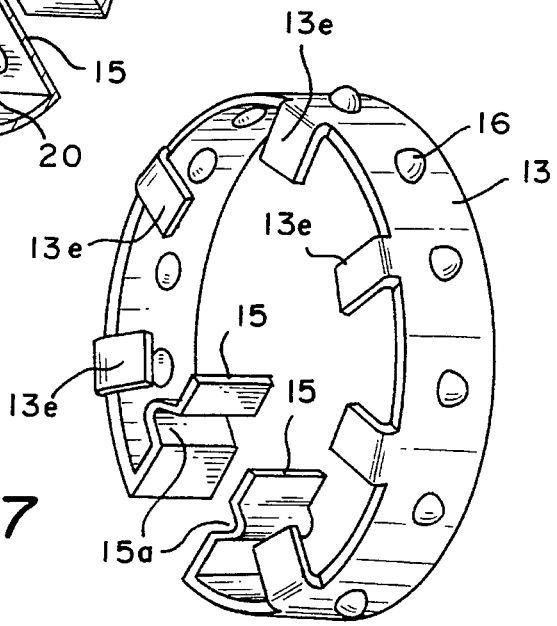

While FIG. 6 illustrates the arcuate leaf spring 13 shown in FIGS. 1 to 5, FIG. 7 illustrates a modification of the arcuate leaf spring wherein the leaf spring is provided with circumferentially spaced, inwardly bent tabs 13*e* which are adapted to engage the bottom face of the deflector plate 10, when in the operative position. Also, in lieu of the hemispherical protrusions 20 provided in the tabs 15, the tabs 15 are bent to provide recesses 15*a* for receiving the fusible link 18.

Figure 8:
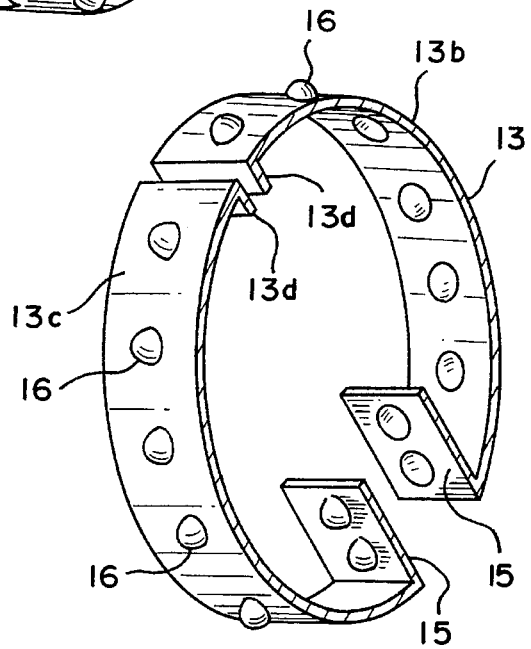

FIG. 8 illustrates a further modification of the arcuate leaf spring 13, wherein the spring is provided by a pair of semicircular leaf springs 13*b* and 13*c* having inwardly bent tab portions 13*d* which are adapted to be in abutting relationship when mounted in operative position.

Figure 9:
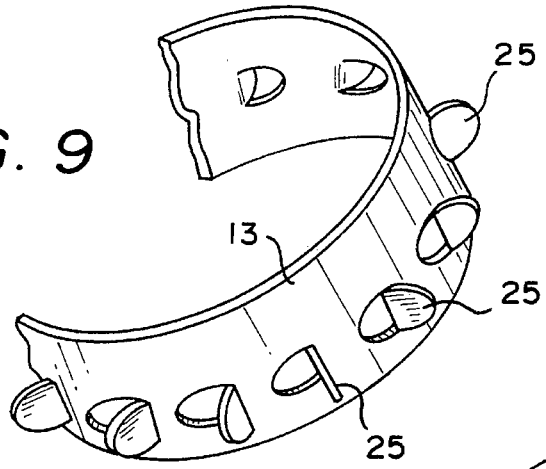
FIGS. 9, 10, and 11 are perspective views of further embodiments of the arcuate leaf spring employed in the locking mechanism of the present invention.
Figure 10:
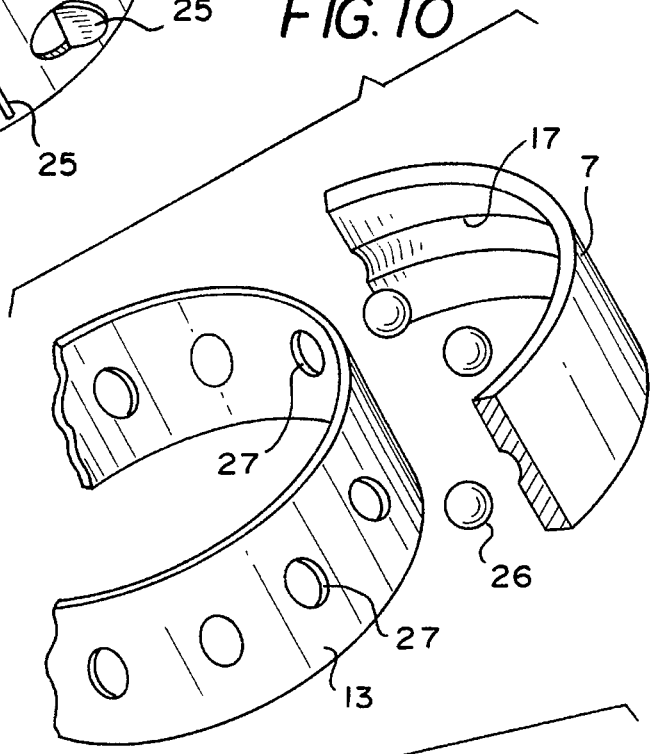
Figure 11:
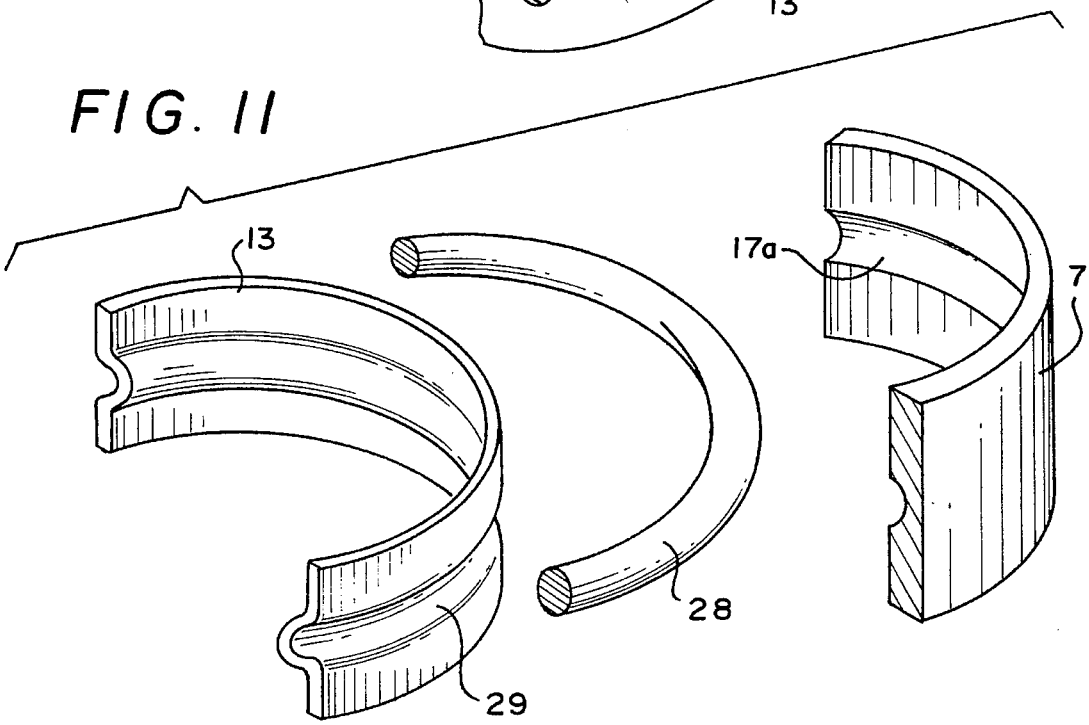

FIGS. 9 to 11 illustrate further modifications or embodiments of the arcuate spring 13 and associated peripheral protrusions adapted to engage the valve housing groove 17. In FIG. 9, the protrusions are provided with outwardly struck ears 25. In FIG. 10, a plurality of balls 26 are adapted to be mounted in respective circumferentially spaced apertures 27 provided in the arcuate leaf spring, and, in FIG. 11, a circumferentially extending annular wire 28 is positioned within an annular groove 29 provided in the annular leaf spring 13.

Figure 12:
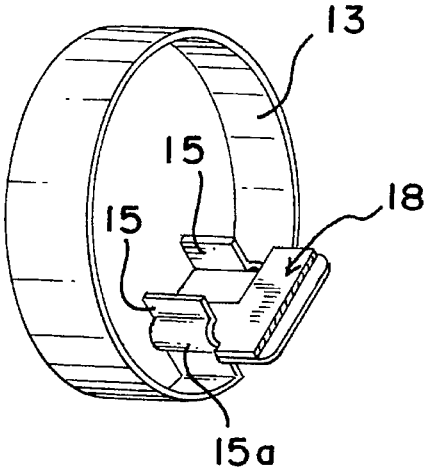
FIGS. 12, 13, and 14 are perspective views of various embodiments of the ambient temperature responsive element employed for biasing the arcuate leaf spring in a radially outward direction.
Figure 13:
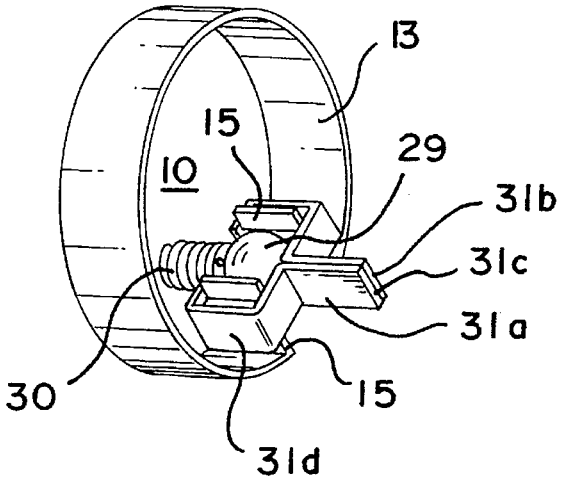
Figure 14:
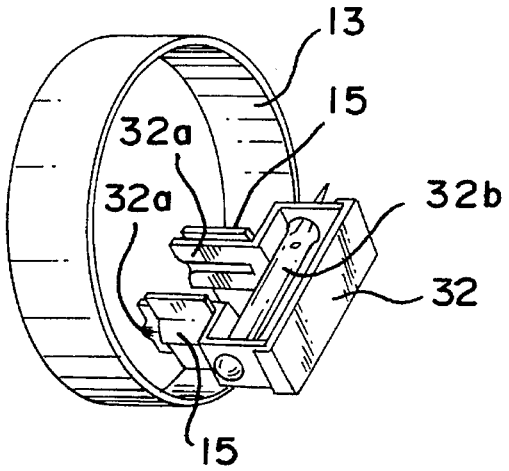

FIGS. 12 to 14 illustrate the use of various fusible links for holding the arcuate leaf spring 13 in the outwardly extended position. FIG. 12 illustrates the use of the fusible link 18 shown in FIGS. 1, 2, and 4 mounted in the recessed tabs 15 shown in FIG. 7. In FIG. 13, a spring biased ball 29 is positioned between the tabs 15 for holding the arcuate leaf spring 13 in the extended position. A compression spring 30 is positioned between the deflector plate 10 and the ball 29. The spring-biased ball 29 is held in the mounted position by a pair of plates 31*a* and 31*b* held together as at 31*c* by a lower melting point solder and configured to form a channel portion 31*d* straddling the tabs 15 on the sides thereof opposite to the sides engaged by the ball 29. When the solder melts, the plates 31*a* and 31*b* separate and the spring biased ball 29 is released thereby allowing the arcuate leaf spring 13 to contract. In FIG. 14, the fusible link comprises a bifurcated bracket 32 having leg members 32*a* inserted between the spring tabs 15 for holding the spring in the expanded position. A fusible bulb 32*b* is provided for holding the leg members 32*a* in a biasing position spreading the tabs apart. When the bulb 32*b* breaks the biasing force on the leg members 32*a* is released, thereby, allowing the annular leaf spring 13 to contract.

From the above description, it will be readily apparent to those skilled in the art that the locking mechanism of the present invention overcomes the disadvantages experienced with prior sprinkler locking mechanisms in that it is inexpensive to manufacture, has few parts, is easy to assemble, resulting in a low cost mechanism conforming to UL standards, including the requirement that the lock must release under 14 seconds when subjected to the UL Heat Sensitivity Test, and it must hold up to 700 psi for one minute without failure of the lock to hold the valve closed and not leak.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

I claim:

1. In combination, a locking mechanism, and a quick responsive fire sprinkler of a type having a valve housing including a through bore, one end of said bore being connected to a source of water pressure, a valve slidably mounted in another end of said bore to prevent flow of water therethrough, and a deflector plate integral with said valve and positioned axially outwardly of said other end of said bore, said valve housing having a depending cylindrical skirt portion, an annular groove being provided on an inner surface of said skirt portion; said locking mechanism comprising means for providing an arcuate leaf spring positioned within the skirt portion, a peripheral edge portion of said arcuate leaf spring abutting the deflector plate for holding the valve in a closed position, means for providing a circumferentially extending protrusion mounted on and extending radially outwardly from said arcuate leaf spring, said protrusion extending into said annular groove, said arcuate leaf spring having an inherent radially inwardly directed biasing force, and means for providinq a fusible link operatively connected to said arcuate leaf spring for applying a radially outwardly biasing force to said arcuate leaf spring to bias the protrusion into said groove, whereby the valve is releasably locked in the closed position.

2. The combination according to claim 1, wherein the means for providing said arcuate leaf spring comprises an arcuate leaf spring having a split with spaced, radially inwardly extending tabs at said split, said fusible link being mounted in a space between said tabs for biasing the arcuate spring in a radially outwardly extending direction.

3. The combination according to claim 2, wherein the means for providing the fusible link comprises laminated plates held in face-to-face relationship by a low melting point solder, and a pair of parallel, spaced slots provided in said laminated plates, said tabs being inserted into said slots, whereby the arcuate leaf spring is forced radially outwardly.

4. The combination according to claim 3, wherein a pair of spaced protrusions are provided on each tab, the plate slots being received in spaces between said pair of spaced protrusions.

5. The combination according to claim 2, wherein the means for providing the fusible link comprises a ball positioned in the space between the tabs for biasing the tabs away from each other, and a compression spring biased between the ball and the deflector plate.

6. The combination according to claim 2, wherein the means for providinq the fusible link comprises a bifurcated bracket having leg members inserted between said tabs, and a fusible bulb mounted in said bracket for holding the leg members in a biasing position spreading the tabs apart.

7. The combination according to claim 2 wherein each tab is provided with a recess, said fusible link being mounted in said recesses.

8. The combination according to claim 7, wherein a plurality of circumferentially spaced, radially inwardly extending tabs are integral with the peripheral edge portion of the arcuate leaf spring adapted to engage the deflector plate.

9. The combination according to claim 2, wherein the arcuate leaf spring comprises a pair of semicircular leaf springs, a second pair of radially inwardly extending tabs being provided on opposing end portions of said pair of semicircular leaf springs, said second pair of tabs being in abutting relationship when the leaf spring is mounted in operative position.

10. The combination according to claim 1, wherein the means for providing the circumferentially extending protrusion comprises a plurality of circumferentially spaced semispherical protrusions provided on an outer peripheral face of said arcuate leaf spring.

11. The combination according to claim 1, wherein the means for providing the circumferentially extending protrusion comprises outwardly struck ears provided on an outer peripheral face of said arcuate leaf spring.

12. The combination according to claim 1, wherein the means for providing the circumferentially extending protrusion comprises a plurality of circumferentially spaced apertures provided in a peripheral face of said arcuate leaf spring, and a plurality of circumferentially spaced balls mounted in the respective apertures.

13. The combination according to claim 1, wherein the means for providing the circumferentially extending protrusion comprises an annular groove provided in a peripheral face of the arcuate leaf spring, and a circumferentially extending annular wire positioned in said annular groove of said arcuate spring.

14. The combination according to claim 1, wherein a decorative cover is connected to said arcuate leaf spring, and an opening is provided in said cover, said fusible link extending through said cover.

* * * * *